US006776466B2

(12) United States Patent
Harvie, III

(10) Patent No.: US 6,776,466 B2
(45) Date of Patent: Aug. 17, 2004

(54) ADJUSTABLE CABINET SHELF SUPPORT SYSTEM WITH SLIDABILITY

(75) Inventor: William Harvie, III, Yardley, PA (US)

(73) Assignee: Maax-KSD Corporation, Southampton, PA (US)

( * ) Notice: Subject to any disclaimer, the term of this patent is extended or adjusted under 35 U.S.C. 154(b) by 0 days.

(21) Appl. No.: 10/279,640

(22) Filed: Oct. 24, 2002

(65) Prior Publication Data

US 2004/0080249 A1 Apr. 29, 2004

(51) Int. Cl.[7] ..... A47B 95/00; A47G 25/02

(52) U.S. Cl. ..... 312/351; 108/108; 248/250; 211/193

(58) Field of Search ..... 108/107, 108, 108/110, 147.17; 312/351, 245; 248/222.51, 222.52, 250, 243; 211/90.02, 50.04, 193, 207, 103, 94.01

(56) References Cited

U.S. PATENT DOCUMENTS

| | | | | | |
|---|---|---|---|---|---|
| 2,901,206 | A | * | 8/1959 | Gredell | 248/246 |
| 3,826,207 | A | * | 7/1974 | Sutherlan | 108/108 |
| 4,156,515 | A | * | 5/1979 | Mochly | 248/246 |
| 4,421,289 | A | * | 12/1983 | Sturm | 248/246 |
| 4,538,784 | A | | 9/1985 | O'Flanagan | 248/244 |
| D286,742 | S | | 11/1986 | Gohrig | D8/381 |
| D288,900 | S | | 3/1987 | Gohrig | |
| 4,653,563 | A | | 3/1987 | Bannister | 160/135 |
| 4,895,331 | A | * | 1/1990 | Nehls | 248/245 |
| 5,170,898 | A | * | 12/1992 | Katz et al. | 211/193 |
| 5,318,264 | A | * | 6/1994 | Meiste | 248/222.12 |
| 5,388,796 | A | * | 2/1995 | Sullivan | 248/246 |
| 5,404,822 | A | | 4/1995 | Jaskiewicz | 108/108 |
| 6,017,009 | A | | 1/2000 | Swartz et al. | 248/245 |
| 6,105,794 | A | * | 8/2000 | Bauer | 211/94.01 |

FOREIGN PATENT DOCUMENTS

| | | | | |
|---|---|---|---|---|
| CH | 368374 | * | 5/1963 | 248/243 |
| GB | 17336 | * | of 1906 | 248/243 |
| IT | 645264 | * | 9/1962 | 108/108 |

* cited by examiner

*Primary Examiner*—Janet M. Wilkens
(74) *Attorney, Agent, or Firm*—Michael F. Petock, Esq.

(57) ABSTRACT

A slidably adjustable cabinet shelf support utilizes a groove and a bracket mounted into the groove which is slidable along the groove and lockable in a desired position. The bracket may be comprised of a first and a second portion for transverse members. The transverse members are inserted into the groove and rotated. The two portions of the bracket are then mounted together by a screw or other fastener which is threadably mounted in one portion of the bracket and passed through the other. The threaded fastener may then be tightened against the back wall of the groove to lock the bracket in place.

8 Claims, 4 Drawing Sheets

ADJUSTABLE CABINET SHELF SUPPORT SYSTEM WITH SLIDABILITY

FIELD OF THE INVENTION

The present invention relates to a cabinet shelf support system. More particularly, the present invention relates to a cabinet shelf support system which is provided with a bracket which may be slidably adjusted to a particular position and locked in place.

BACKGROUND OF THE INVENTION

Shelves in cabinets are supported in some means and are often desired to be adjustable. A typical means of providing such support with adjustability is to provide a plurality of holes drilled in the cabinet wall wherein pins are inserted. The shelf is supported on the pins. The holes are drilled at discrete locations. The pins have to be physically removed and placed into another set of holes to adjust the shelf position. Further, adjustability is limited to the spaced apart distance between holes.

SUMMARY OF THE INVENTION

The present invention provides a cabinet shelf support system which has slidability for adjusting the position of brackets or shelves supported on the brackets.

More particularly, the present invention comprises an apparatus which includes a groove. The groove may be in a track mounted to the cabinet wall or it may be formed in the cabinet wall. The groove is provided with an opening between a pair of sidewalls with the opening extending laterally behind the sidewalls. A bracket is mountable in the groove. The bracket is slidable along the groove and includes structure for locking the bracket in a position along the groove.

The bracket includes a first portion and a second portion. The first and second portions each being provided with a transverse member. Each of the transverse members is insertable into the opening and rotatable to extend into the opening extending laterally behind the sidewalls. The first and second portions include structure for connecting the first and second portions together.

The bracket in a preferred embodiment includes a structure for supporting a shelf. The structure for supporting the shelf includes an elongated member extending to support the shelf and structure for retaining the shelf on the elongated member.

In a presently preferred embodiment, a second groove and a second bracket is provided in a cabinet. In this manner, a shelf may be mounted on a pair of brackets and may be slidably adjustable to any position along the length of the groove and locked in place at any desired location.

However, it is understood that a single bracket may be utilized with a groove to provide an adjustable support for hanging items, such as an adjustable hook from which items may be hung or otherwise supported.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
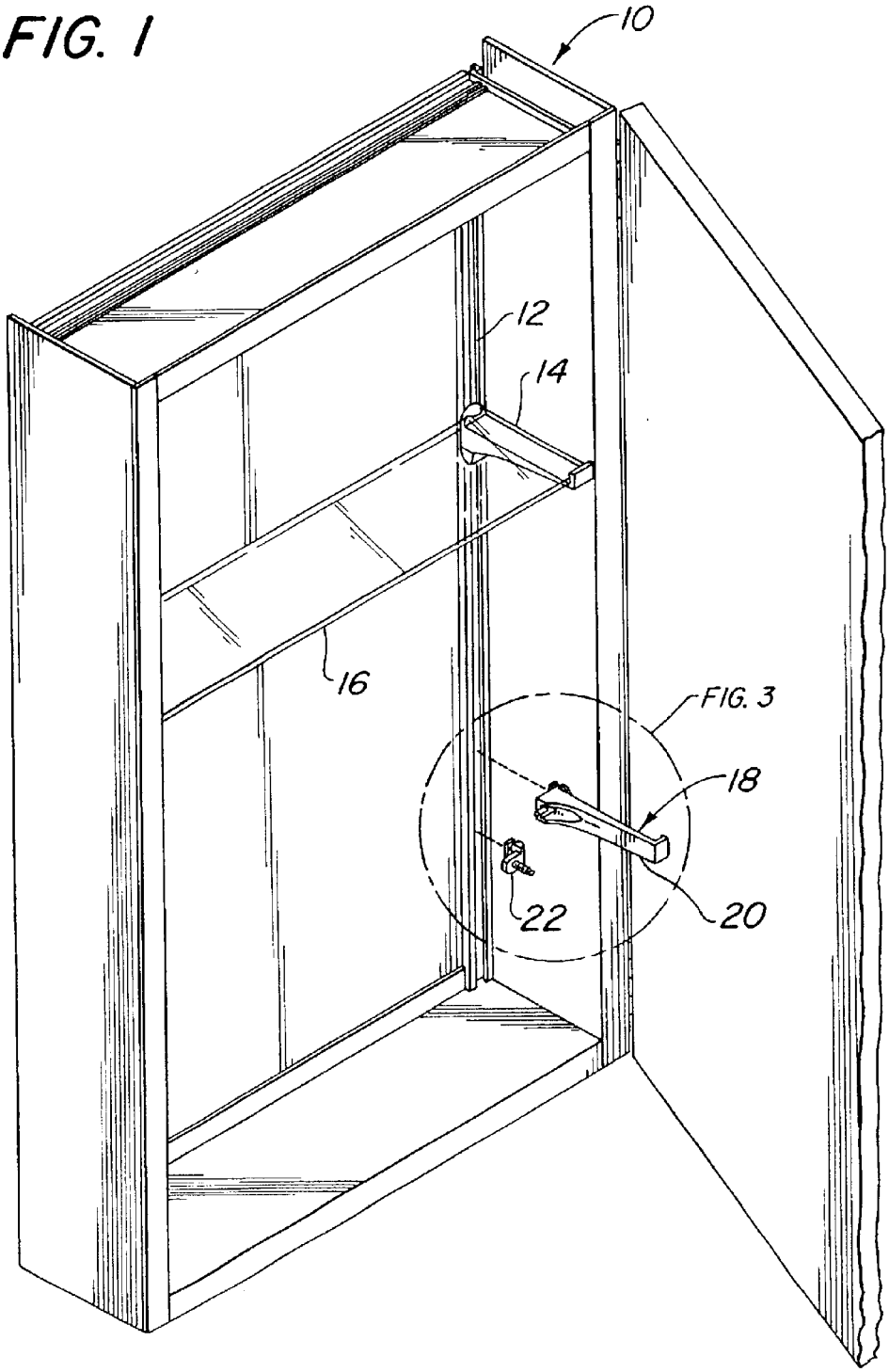
FIG. 1 is a view in perspective of a cabinet provided with a slidably adjustable shelf support system including a groove and a bracket in accordance with an embodiment of the present invention.

Referring now to the drawings, wherein like numerals indicate like elements, referring now to FIG. 1, there is shown a cabinet 10. Cabinet 10 is illustrated to be a bathroom cabinet in a presently preferred embodiment, however it is understood that the slidable support shelf system of the present invention may be utilized in any type of a cabinet. On the back wall of cabinet 10, there is a groove 12. Groove 12 may be formed as part of a track mounted to a cabinet wall or it may be formed as a part of the cabinet wall in any suitable manner, such as in the manufacturing of the cabinet wall. The groove structure may be made of any suitable material, however, a presently preferred material is aluminum. However, it is understood that the groove structure may be made of plastic or any suitable material and that the groove 12 may be molded and formed of any suitable material as a part of the wall of a cabinet, including plastic, aluminum or other suitable material. In a presently preferred embodiment, a groove 12 is formed on an inward projection 15 of the back end of the sidewall 17 of cabinet 10 from extruded aluminum, as may be best seen in FIGS. 3, 4, 5 and 7.

As illustrated in FIG. 1, a bracket 14 is mounted in groove 12. Another bracket on the left side is provided, which may not been seen because of the left wall of the cabinet. A shelf 16 is mounted on the bracket 14 and the other unshown bracket.

A second bracket 18 is also illustrated in FIG. 1. Bracket 18 is comprised of portions 20 and 22. As shown in FIG. 1 and illustrated in enlarged form in FIG. 3, bracket portions 20 and 22 are in the process of being inserted into groove 12. The brackets may be comprised of any suitable substantially rigid material including plastic and various metals. In a presently preferred embodiment, the entire bracket structure is comprised of plastic including portions 20 and 22, which include the elongated member 44 of portion 20 and the retaining member or screw of 52 of portion 22 which will be discussed in more detail hereinafter.

Figure 3:
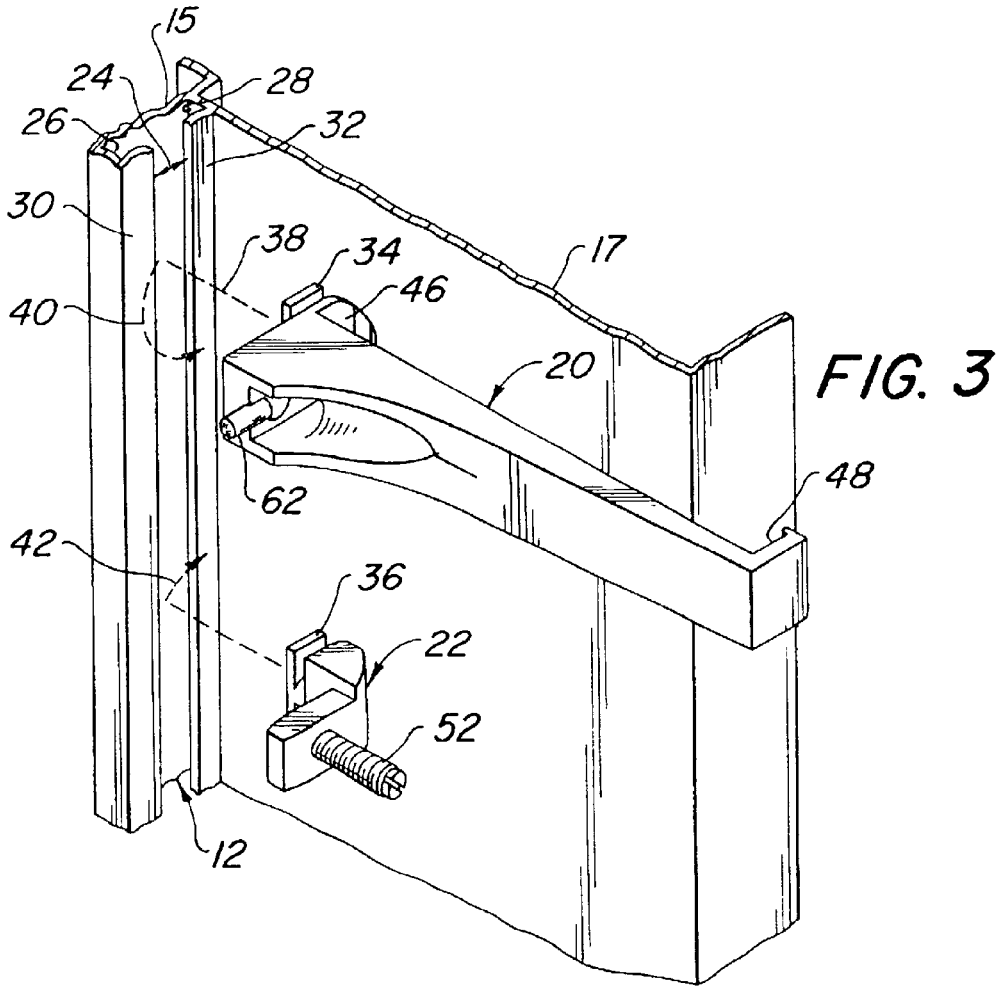
FIG. 3 is an exploded view in perspective of the portion of FIG. 1 shown in dotted lines and marked FIG. 3 which illustrates the insertion of the two portions of the bracket into the groove and the rotation thereof as a part of the insertion process of the bracket into the groove.
Figure 4:
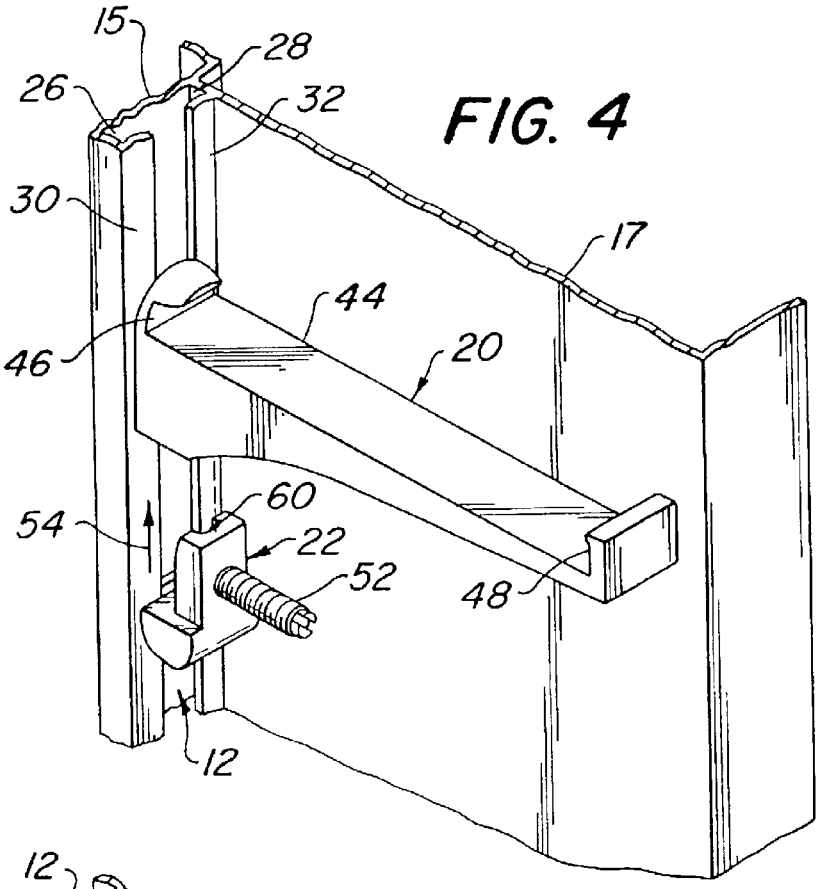
FIG. 4 is a partially broken away enlarged view in perspective of the two portions of the bracket mounted in a groove and in the process of being connected together.

As illustrated in FIGS. 3 and 4, groove 12 is provided with an opening 24 which extends laterally at 26 and 28 behind sidewalls 30 and 32 of groove 12.

Bracket portion 20 is provided with a transverse member 34 and bracket portion 22 is provided with a transverse member 36. In a presently preferred embodiment as illustrated, transverse members 34 and 36 are integrally formed as a part of brackets 20 and 22, respectively. However, it is understood within the scope of the present invention that transverse members 34 and 36 could be rotatable with respect to the remainder of bracket portions 20 and 22. In such a case, the transverse members would be mounted to a rod or other connecting means which could be rotated to insert the transverse member into the groove and then rotated to cause the transverse member to go into the lateral portions of the groove behind sidewalls 30 and 32.

In a presently preferred embodiment as illustrated in FIG. 3, transverse member 34 is inserted into groove 12 as shown by dotted line 38. Once transverse member 34 is within opening 24 of groove 12, it is rotated as shown by dotted arrow 40. In a similar manner, transverse member 36 of bracket portion 22 is inserted into groove 12 and rotated as illustrated by dotted arrow 42.

Figure 2:
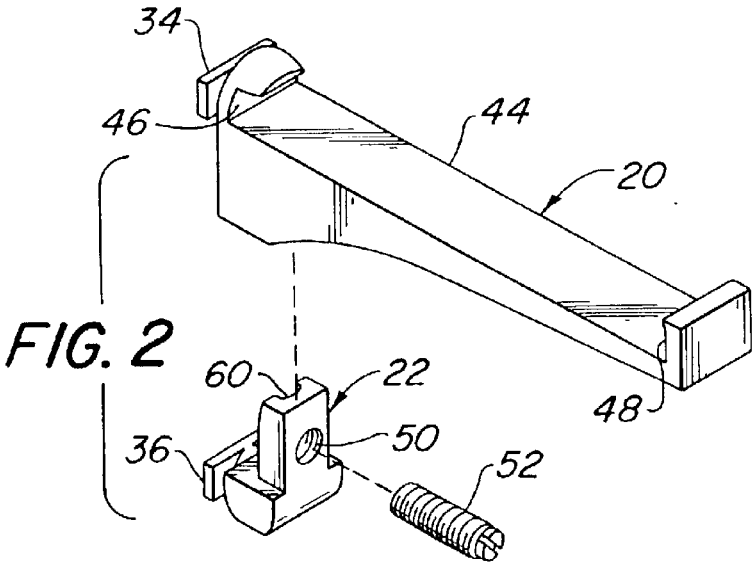
FIG. 2 is an enlarged view in perspective of the two portions of the bracket.

Bracket portions 20 and 22 are also illustrated in FIG. 2. As illustrated in FIG. 2, bracket portion 20 is provided with a structure for supporting a shelf in the form of an elongated member 44. Elongated member 44 is provided with a structure for retaining a shelf on the elongated member in the form of indent 46 near one end and smaller indent 48 near the other end. In this manner, a shelf may be inserted into indent 46 and then snapped into place behind indent 48 to retain it in position. It is understood that the location of the two indents may be reversed, that is, the longer indent may be formed on elongated member distant from the groove and the smaller indent near the other end. Further, it is understood that the indents may be of the same or substantially the same size.

As may be best seen in FIG. 2, bracket portion 22 is provided with threads 50 for receiving retaining screw 52.

Figure 5:
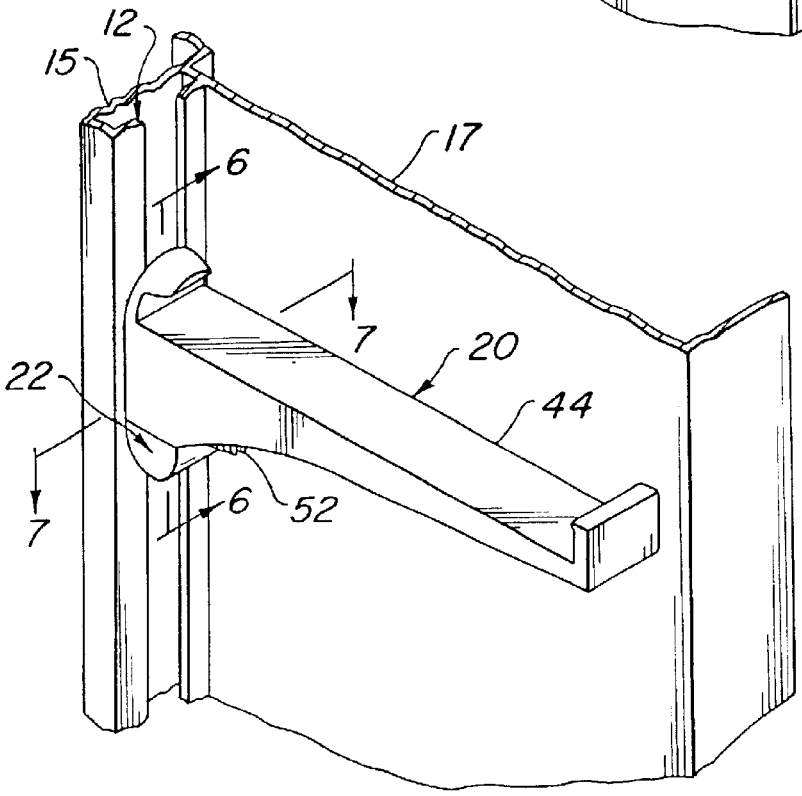
FIG. 5 is a partially broken away enlarged view in perspective of a bracket mounted in a groove.

As may be best seen in FIG. 4, once bracket portions 20 and 22 have their respective transverse members mounted within the lateral portion of the groove opening behind sidewalls 30 and 32, portion 22 may be slid in the direction of arrow 54 to achieve the position shown in FIG. 5. It is understood that, alternatively, portion 20 may be slid toward portion 22.

Figure 6:
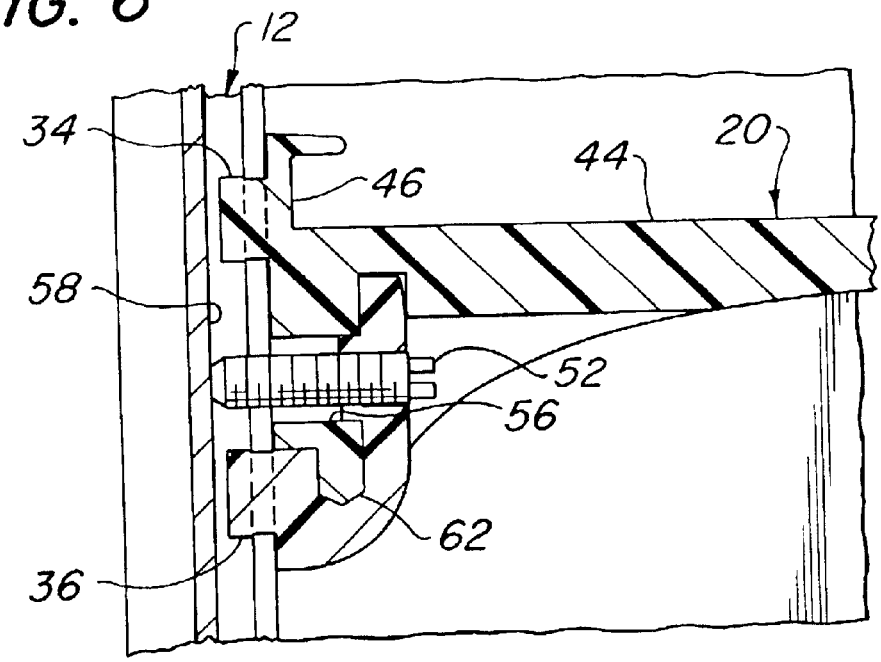
FIG. 6 is a cross sectional view taken along line 6—6 of FIG. 5.
Figure 7:
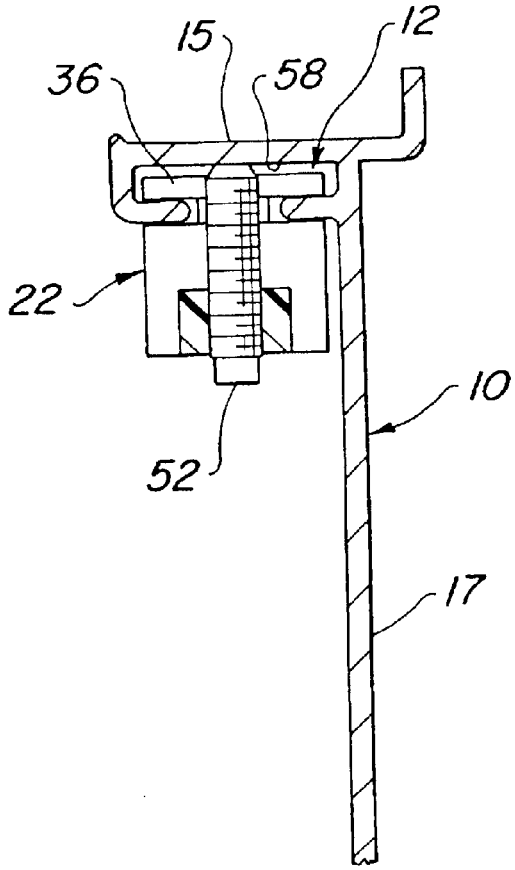
FIG. 7 is a cross sectional view taken along line 7—7 of FIG. 5.

Referring to FIGS. 5, 6 and 7 together, once in this position, the retaining screw 52 is tightened causing it to pass through a hole or opening 56 in bracket portion 20 to hold the bracket portions 20 and 22 together. As screw 52 is tightened further, it impinges against the back wall 58 of groove 12 causing the bracket 18 comprised of bracket portions 20 and 22 to be locked in place. The tightening of retaining screw or threaded member 52 against the back wall forces the end portions of transverse member 36 against the back of the sidewalls 30 and 32 of groove 12.

If it is desired to change the location of the bracket along the groove, retaining screw 52 needs only to be loosened slightly, and the bracket may be slid upwardly or downwardly in the groove. Once at the new desired location, retaining screw 52 may be tightened to again lock the bracket in the new position.

To provide a more secure connection between bracket portions 20 and 22, they may be provided with mating structures. For example, as illustrated in FIG. 4, bracket portion 22 may be provided with a curved or rounded indentation 60 which mates with a bar or guide 62 formed on bracket portion 20. However, it is understood that various other shapes and types of mating structure to enhance the connection between bracket portions 20 and 22 may be utilized.

As discussed above, a bracket in one groove and another bracket in a groove spaced from the first groove may be used to support a shelf. The shelf may be mounted in a cabinet of any type, and by loosening screws 52, the brackets may be slid to any position along the track to adjust the position of the shelf. A cabinet may be provided with a plurality of shelves with each shelf having its own set of brackets. The cabinet may be provided with a tool for loosening and tightening screw 52. It is understood that screw 52 may be provided with any suitable head engaging structure, such as a slot for a straight screw driver, a phillips head, a hex head for a socket or any other shape which may mate with a tool for tightening and loosening the screw or other threaded retaining structure.

Additionally, it is understood that a single bracket in a track may be utilized as a slidably adjustable hook for hanging items or otherwise supporting items. In this manner the bracket would be provided with a hook-like or other support structure which may be slidably adjusted along the length of the groove. A single bracket slidably adjustable in the groove may be used to support a small shelf or other shaped holder of objects.

The present invention may be embodied in other specific forms without departing from the spirit or essential attributes thereof and, accordingly, reference should be made to the appended claims, rather than to the foregoing specification as indicating the scope of the invention.

I claim:

1. An apparatus, comprising:

a groove, said groove having an opening between a pair of sidewalls, said opening extending laterally behind said sidewalls;

a bracket mountable in said groove, said bracket being slidable along said groove and including structure for locking said bracket in a position along said groove; and said bracket including a first portion and a separate second portion, said first and second portions each being provided with a transverse member, each of said transverse members being insertable in said opening and rotatable to extend into said opening extending laterally behind said sidewalls, said first and second portions including structure connecting said first and second portions together.

2. An apparatus in accordance with claim 1 wherein said first portion of said bracket includes structure for supporting a shelf.

3. An apparatus in accordance with claim 2 wherein said structure for supporting said shelf includes an elongated member extending to support said shelf and structure for retaining said shelf on said elongated member.

4. An apparatus in accordance with claim 1 including a second groove and a second bracket.

5. An apparatus in accordance with claim 4 wherein said first and second grooves are along the back wall of a cabinet, said first and second brackets are mounted in said first and second grooves, respectively.

6. An apparatus in accordance with claim 5 wherein said first and second brackets are provided with an elongated member for supporting a shelf in said cabinet.

7. An apparatus in accordance with claim 6 including a third and fourth bracket provided with an elongated member for supporting a second shelf in said cabinet.

8. An apparatus in accordance with claim 1 wherein said groove is provided with a back wall and wherein said structure for locking said bracket in a position along said groove includes a member threadably mounted in said bracket wherein said threaded member may be threadably forced against said back wall for locking said bracket in position.

* * * * *